US005659982A

United States Patent [19]

Muraoka et al.

[11] Patent Number: 5,659,982

[45] Date of Patent: Aug. 26, 1997

[54] BICYCLING SHOES

[75] Inventors: Tsutomu Muraoka; Satoshi Watanabe, both of Sakai, Japan

[73] Assignee: Shimano Inc., Osaka, Japan

[21] Appl. No.: 500,996

[22] PCT Filed: Dec. 27, 1994

[86] PCT No.: PCT/JP94/02252

§ 371 Date: Aug. 9, 1995

§ 102(e) Date: Aug. 9, 1995

[87] PCT Pub. No.: WO95/17835

PCT Pub. Date: Jul. 6, 1995

[30] Foreign Application Priority Data

Dec. 28, 1993 [JP] Japan ..... 5-070535
Dec. 28, 1993 [JP] Japan ..... 5-070853

[51] Int. Cl.[6] ..... A43B 5/14; A43C 11/00

[52] U.S. Cl. ..... 36/131; 36/50.1

[58] Field of Search ..... 36/50.1, 50.5, 36/89, 131

[56] References Cited

U.S. PATENT DOCUMENTS

| | | | |
|---|---|---|---|
| 4,130,949 | 12/1978 | Seidel et al. . | |
| 4,269,558 | 5/1981 | Antonious | 26/50.1 |
| 4,282,657 | 8/1981 | Antonious | 36/50.1 |
| 4,753,022 | 6/1988 | Gasbarro | 36/11.5 |
| 5,269,078 | 12/1993 | Cochrane | 36/50.1 X |
| 5,408,761 | 4/1995 | Gazzano | 36/58.6 |
| 5,469,640 | 11/1995 | Nichols | 36/50.1 |
| 5,497,564 | 3/1996 | Allen et al. | 36/50.1 |

FOREIGN PATENT DOCUMENTS

| | | | |
|---|---|---|---|
| 2615074 | 11/1988 | France . | |
| 597297 | 5/1934 | Germany | 36/50.1 |
| 8413016 | 8/1984 | Germany . | |
| 8810202 | 9/1988 | Germany . | |
| 8909016 | 1/1990 | Germany . | |
| 324943 | 2/1935 | Italy | 36/11.5 |
| 52090349 | 7/1977 | Japan . | |
| 04048807 | 4/1992 | Japan . | |
| 04095703 | 8/1992 | Japan . | |
| 05084105 | 4/1993 | Japan . | |
| 405084105 | 4/1993 | Japan | 36/50.1 |

*Primary Examiner*—Ted Kavanaugh
*Attorney, Agent, or Firm*—Shinjyu Office of Patent Attorneys

[57] ABSTRACT

A bicycling shoe having a shoe main body, a first tension-binding belt, a second tension-binding belt, a free ring, and a tensioning implement. The first tension-binding belt has at least one end connected to the shoe main body and has a first turnover portion. The second tension-binding belt has at least one end connected to the shoe main body and has a second turnover portion adjacent to the first turnover portion. The first and second turnover portions are inserted through the free ring such that the first and second belts link. Herein, since the belts having the turnover portions are linked by the free ring, fine adjustment can be made by means of the belts, responding to the shape of the foot of an individual wearer. Further, since a construction is made in which the first tension-binding belt is fixed to the shoe main body under tension by the tensioning implement, the shoes can be put on and taken off easily. When the tensioning implement is in the form of a folded-back belt that has "Velcro" on the opposing surfaces, and the first tension-binding belt further has a third turnover portion, and a second free ring is further provided through which the third turnover portion and the tensioning implement are inserted such that the first tension-binding belt and the tensioning implement link, the bound-tight condition of the shoe can be maintained even in severe movement.

15 Claims, 14 Drawing Sheets

BICYCLING SHOES

TECHNICAL FIELD

The present invention relates to shoes and, more particularly, to bicycling shoes furnished with tension-binding articles.

BACKGROUND ART

An example of a bicycling shoe is disclosed in Japanese Patent Laid-Open No. 84105/1993.

As shown in FIG. 14, the shoe has a flexible tension-binding belt 8 that is folded back, one end 8*a* of which is sewn along a lower tip 9*a* of a vamp 9, and the other end 8*b* of which is sewn along a lower butt 9*b* of the vamp 9. The turned portion 10 of the tension-binding belt 8 is hooked into place between an upper-end fore portion 13*a* and an upper-end rear portion 13*b* of another vamp 13, such that it covers shoelace 12 laced across an opening 11. A fastener 15 is fitted to the turned portion 10 through a strap-passing ring 14. The fastener 15 can selectively be fastened to a fastening surface 16 provided spreading from a tip 13*c* to a butt 13*d* of the vamp 13.

With a bicycling shoe from the above-mentioned construction, when in actual use, the adjusting that should hold the shoe fast to the feet is by the shoelace 12. The tension-binding belt 8 is utilized only for preventing the secured lace 12 from coming loose. For this reason, when putting on and taking off the shoe, one must manipulate the tension-binding belt 8 together with the shoelace 12.

Moreover, in an instance a shoe from the aforementioned construction is to be utilized, for example, in the competition bicycling that is attended by violent pushing-down and pulling-up actions of the leg such that the entire shoe is distorted, the fastening surface 16, effected by the distorting to the entire shoe, Simply doesn't hold up, as a result of which the fastening surface 16 easily deforms, and cannot retain the fastener 15.

DISCLOSURE OF THE INVENTION

An object of the present invention is to provide with a bicycling shoe that is easy to wear and remove, and that can adjust finely to the shape of the individual wearer's foot.

Another object of the present invention is to provide a bicycling shoe that is easy to wear and remove, and that holds firmly bound tight even in severe movement.

A shoe in connection with a first aspect of the present invention is a bicycling shoe, and is provided a shoe main body, a first tension-binding belt, a second tension-binding belt, a free ring, and a tensioning implement. The shoe main body has, in the uppermost front portion, a vamp that covers the instep of the foot, and in the uppermost rear portion, it has an opening for inserting the foot. The first tension-binding belt has at least one end connected to the shoe main body, and extends over the vamp and has a first turnover portion. The second tension-binding belt has at least one end connected to the shoe main body and has a second turnover portion which is adjacent to the first turnover portion. The first and second turnover portions are inserted through the free ring such that the first and second tension-binding belts are connected. The tensioning implement is for fixing the first tension-binding belt in a tensioned state to the shoe main body.

Herein, since tension-binding belts that have turnover portions are connected through the free ring, the binding and tightening caused by the tension-binding belts, in responding to the shape of an individual's foot, is finely adjusted. Moreover, since the construction is that the first tension-binding belt is fixed to the shoe main body under a tensioned state brought about by the tensioning implement, it is easy to put on and take off the shoe.

It is also suitable that the second tension-binding belt be connected to the shoe main body in such a manner that the free ring is movable in the longitudinal direction of the shoe. This will accordingly improve the adjusting function. Herein, for example, the second tension-binding belt may have, wherein its position in the longitudinal direction of the shoe is different, a part that extends from the second turnover portion, or a construction is realizable in which the second tension-binding belt is connected freely pivotal to the shoe main body by means of a pin.

When the tensioning implement is in the form of a folded-over belt that has hook-and-loop type gripping elements such as "VELCRO®" on opposed surfaces, and the first tension-binding belt further has a third turnover portion, and a second free ring is further provided through which the third turnover portion and the tensioning implement are inserted such that the first tension-binding belt and the tensioning implement are linked together, an effect is obtained that a tightened and bound state can be firmly maintained even in severe movement.

For this effect to be obtained, it is desirable that the tensioning implement extend downward aslant from the rear end of the vamp toward the lower part of the opening.

Wherein the first tension-binding belt has a fourth turnover portion in a position that puts the third turnover portion in a space between it and the first turnover portion, and the shoe has a third tension-binding belt which has at least one end thereof connected to the shoe main body behind the second tension-binding belt, and has a fifth turnover portion adjacent to the fourth turnover portion, and a third free ring through which the fourth and fifth turnover portions are inserted such that the first and third tension-binding belts link, the adjusting function is improved further.

It is desirable that the shoe main body have a reinforcing belt around its lower end periphery and the ends of the first and second tension-binding belts be positioned at the reinforcing belt. It is also desirable that the free ring possess a pair of linear catching portions which are opposite to each other and broader than the widths of the first and second tension-binding belts.

Shoes in relation to a separate aspect of the present invention are bicycling shoes which include a shoe main body, a tension-binding belt, a tensioning implement, and a free ring. The shoe main body has, in the uppermost front portion, a vamp that covers the instep of the foot, and in the uppermost rear portion, it has an opening for inserting the foot. The tension-binding belt has at least one end connected to the shoe main body, and extends over the vamp and has a first turnover portion. The tensioning implement possesses: a first piece fixed to the shoe main body; a second piece that can be opposed to the first piece; a second turnover portion which integrally connects both of the pieces to each other; and a releasable fixing means placed on the opposing faces of the pieces; so that the tension-binding belt is fixed under tension to the shoe main body. The first and second turnover portions are inserted through the free ring so that the tension-binding belt and the tensioning implement are linked together.

The fact that the tensioning implement has: a first piece fixed to the shoe main body; a second piece that can be opposed to the first piece; a second turnover portion which integrally joins the two pieces to each other; and a releasable fixing means provided on the opposing sides of the two pieces is the reason why the shoes are kept tight despite hard movement and yet easy to put on and take off.

It is desirable that the first piece of the tensioning implement extend downward aslant toward the lower part of the opening from the rear end of the vamp. This improves the holding function.

It is desirable that the shoe main body have a shoe reinforcing belt on its lower end periphery, and that the position of the terminal end of the tension-binding belt is decided by the body of the shoe reinforcing belt.

It is desirable that the free ring possess a pair of linear catching portions which are opposite to each other and broader than the widths of the tension-binding belt and the tensioning implement.

It is desirable that the fixing means be "Velcro®".

Other and further objects, features, and advantages of the invention will appear more fully from the following description.

BEST MODE FOR CARRYING OUT THE INVENTION

Figure 1:
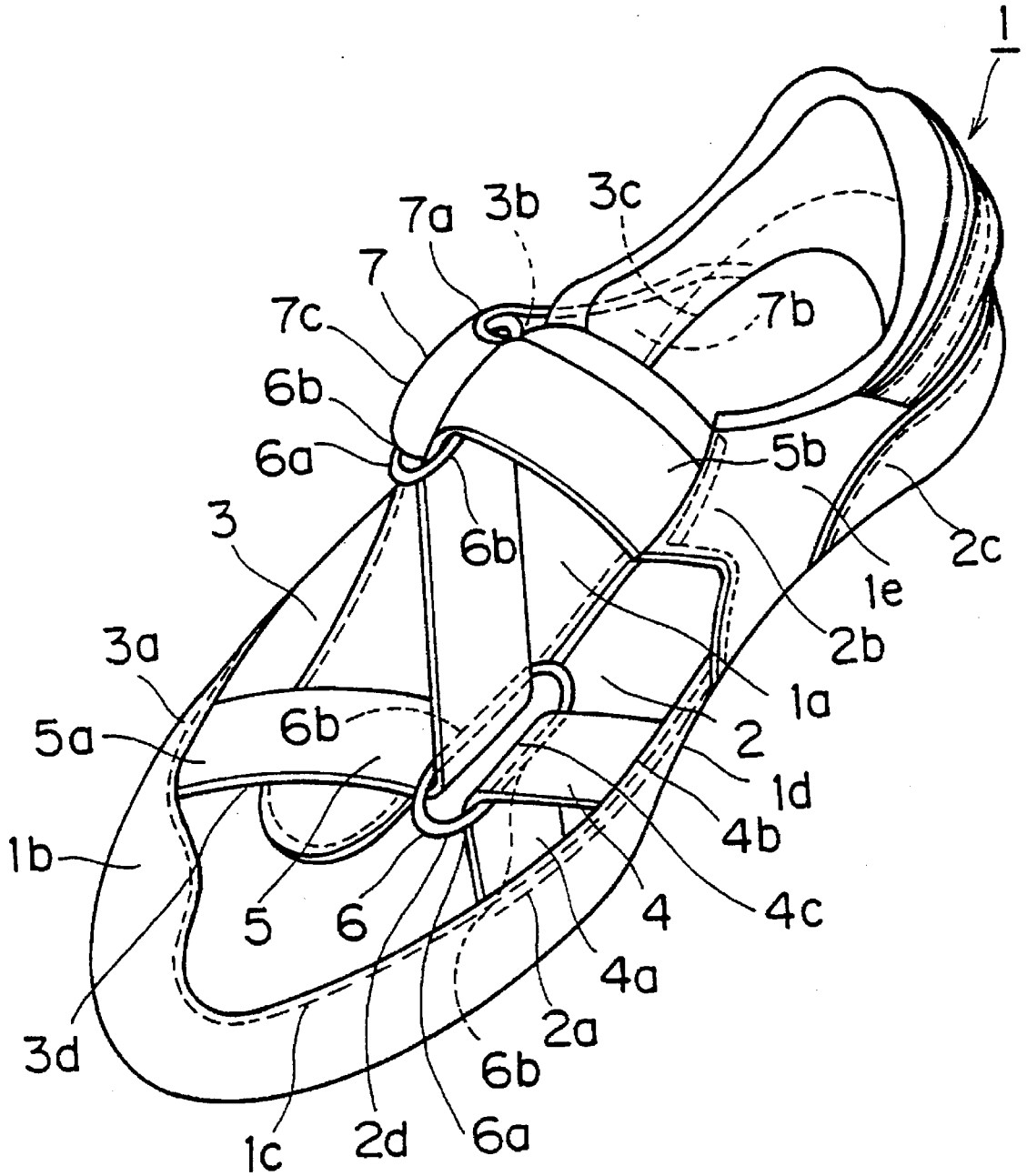
FIG. 1 is an axonometric view of a shoe in relation to the present invention.
Figure 2A:
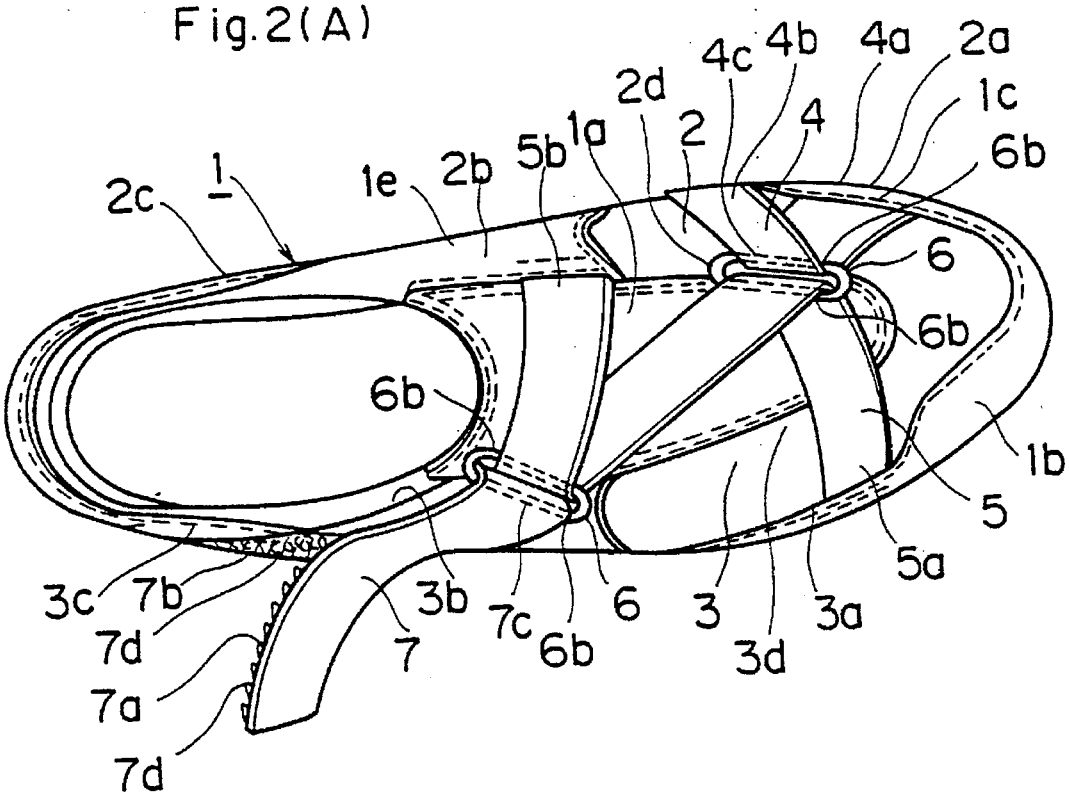
FIGS. 2(A) and 2(B) are a plan view and a side view, respectively, of the shoe of FIG. 1.
Figure 2B:
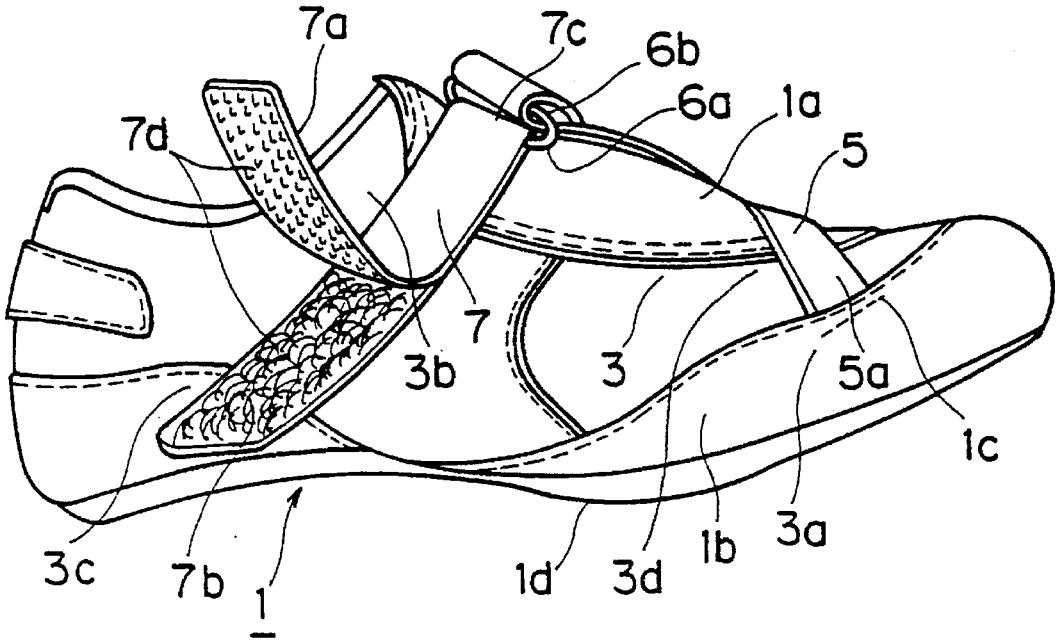

The shoe 1 shown in FIGS. 1 and 2 has an opening in its rear half and also has a vamp (provided with a cloth pad 1*a*) in its forward half.

The shoe 1 has a tension-binding belt 4 at its forward lower part 2*a* of the inside vamp 2. The tension-binding belt 4 is made of non-stretchable plastic such as nylon and is arranged in an inverted V pattern. One end 4*a* and the other end 4*b* of the tension-binding belt 4 are a given distance apart and sewn to specified places in the sewing part 1*c* of the shoe reinforcing belt 1*b*, which is integrally bonded to the sole 1*d* of the shoe 1. The sole of the shoe 1 is provided with a fitting (not shown) which fastens the shoe 1 to a bicycle pedal.

The shoe 1 has a tension-binding belt 5 made of non-stretchable plastic such as nylon, with one end 5*a* thereof sewn to the forward lower part 3*a* of the outside vamp 3 and the other end 5*b* thereof sewn to the rear upper part 2*b* of the vamp 2.

A shoe reinforcing piece 1*e*, which is sewn to the shoe reinforcing belt 1*b* integrally bonded to the shoe sole 1*d*, is sewn to the rear upper part 2*b* of the vamp 2. The tension-binding belts 4 and 5 are passed through an elliptic free ring 6, which has a pair of opposing, linear catching portions 6*b*, and folded back.

The tensioning implement 7 is made of non-stretchable plastic such as nylon. One side 7*a* constitutes a free end and the other side 7*b* constitutes a fixed end. It has a turnover portion 7*c* between the two sides 7*a* and 7*b*. A pair of hook-and-loop type gripping elements (hereinafter referred to as "VELCRO®") 7*d* are sewn to the opposing faces of the two sides 7*a* and 7*b*, so that the position of the turnover portion 7*c* can be adjusted by the placement of the one side 7*a* on the other side 7*b*. The side 7*b* is sewn aslant onto the part extending from the rear upper part 3*b* to the rear lower part 3*c* on the outside of the shoe 1. The turnover portion 7*c* is passed through the tensioning elliptic free ring 6*a*, which has a pair of opposing, linear catching portions 6*b*, and through which the tension-binding belt 5 is inserted to be freely shiftable.

Next, the method of using the shoe 1 will be explained.

Figure 3:
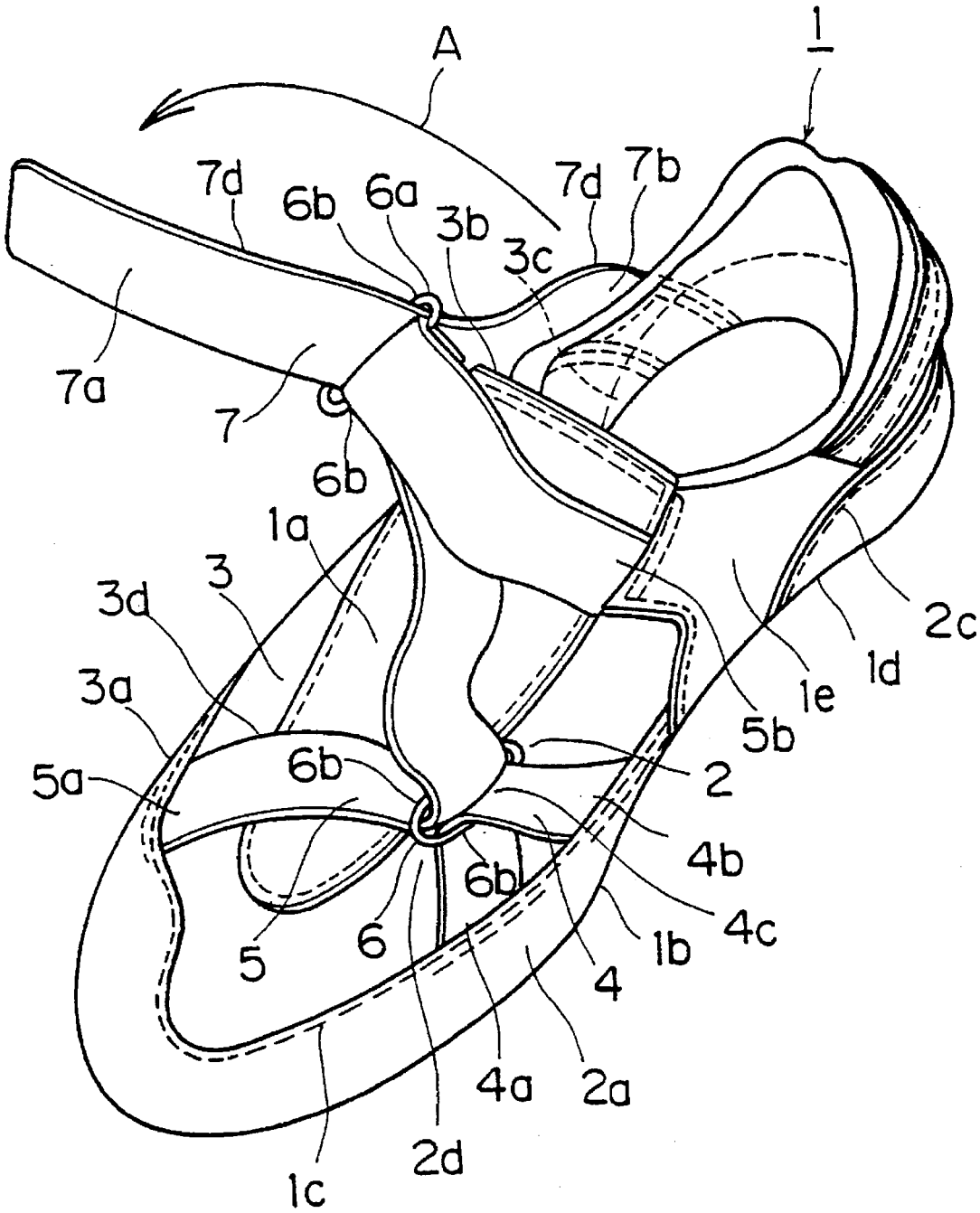
FIG. 3 is an axonometric view of the shoe of FIG. 1, when the tension-binding belt released.

To put on the shoe 1 shown in FIG. 1, the side 7*a*, which is placed on and engaged with the side 7*b* of the tensioning implement 7, is grasped and then peeled off upward (in the direction of the arrow A) as shown in FIG. 3. In this way the tension-binding belt 5 is loosened momentarily and the shoe 1 is opened.

The shoe 1 in the open state is ready for the easy insertion of a foot (not shown). With the foot inserted, the shoe 1 is tightened as the side 7*a* of the tensioning implement 7 is placed on and engaged with the side 7*b* of the tensioning implement 7.

Figure 4:
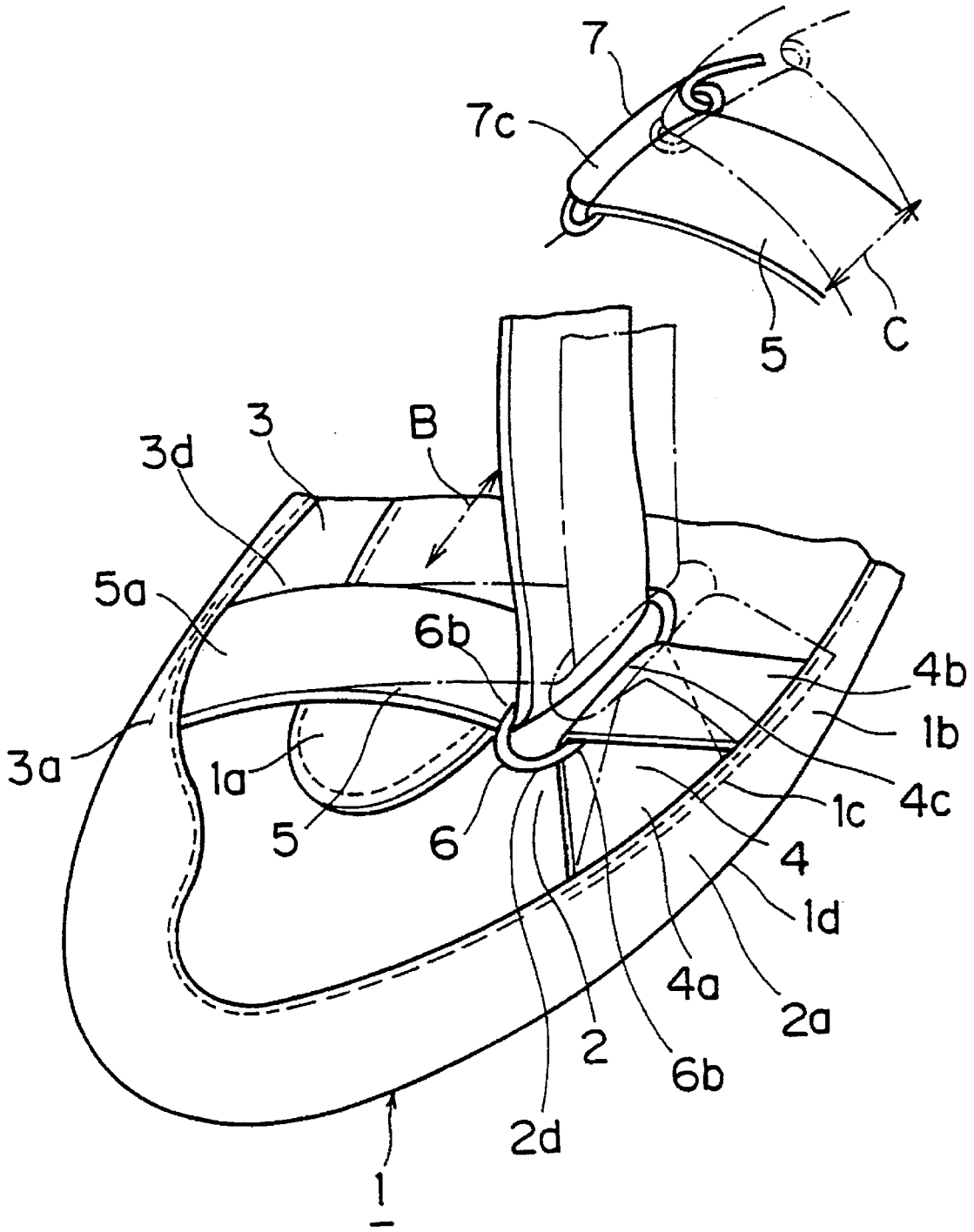
FIG. 4 is an axonometric view which shows the shoe of FIG. 1, when the tension-binding belts and the free rings are in a free-shifting condition.

The shoe 1 holds any foot firmly and comfortably, because the free ring 6 for the belts 4 and 5 and the tensioning implement 7 finely adjusts its position (as shown by solid lines and imaginary lines, and arrows B and C in FIG. 4) according to the height and width of the instep of the feet of the individual wearer. The change in position of the free ring 6 leads to the subtle change in position of the belts 4 and 5 and the folded-back position of the tensioning implement 7. In addition, since the belts 4 and 5 are positioned by the sewing part 1*c* of the reinforcing belt 1*b* integrally bonded to the sole 1*d* of the shoe 1, the shoe 1 is tightened together with the sole. This makes the shoe 1 snugly fit to the foot.

The tensioning implement 7 is affected only slightly by the deformation of the shoe 1 because its side 7*a* is sewn to the side of the shoe 1 within a very narrow strip area. Therefore, the taught state of the shoe 1 is maintained, without the belt 5 coming loose, even when the shoe 1 is used by a racing cyclist who subjects the shoe to severe upward and downward movement which entirely deforms the shoe 1. Furthermore, when the shoe 1 is bound tight, the tension-binding belt 5 hardly causes wrinkling, and it is possible to maintain, for comfortable wear, a good-feeling fit not easily subjected to distorting effects.

Figure 5:
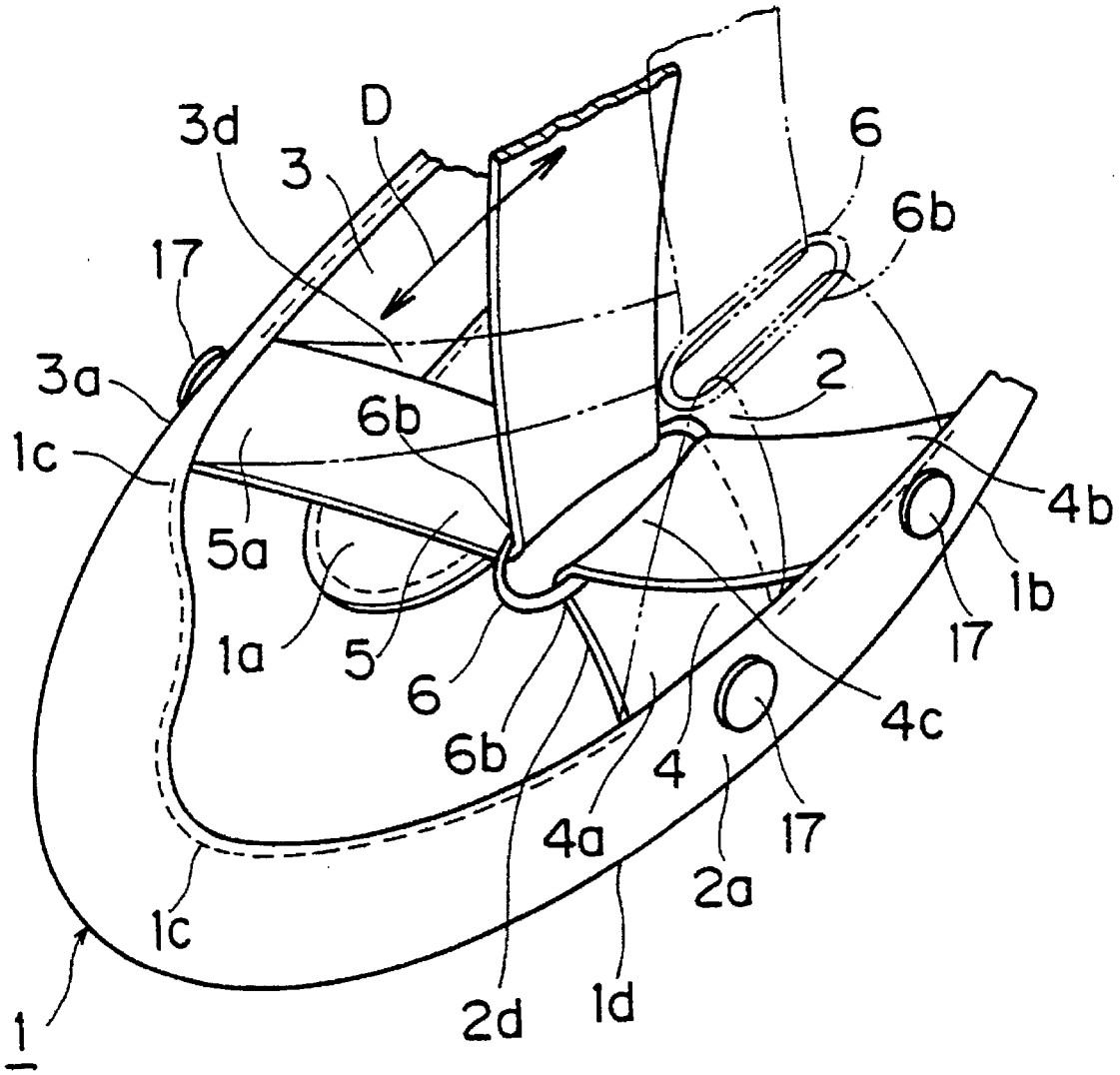
FIG. 5 is an axonometric partial view of the shoe in relation to a different embodiment of the present invention.

In another embodiment, the tension-binding belts 4 and 5 may be pivotally fixed to the reinforcing belt 1*b* of the shoe 1 by means of a press-fitting pin 17, as shown in FIG. 5. In this case the tension-binding belts 4 and 5 can pivot around the pin 17 and thus they can be adjusted more freely, as shown by imaginary lines and arrow D. Alternatively, the same object may be achieved by pivotally joining them with a stretchable sewing thread. Moreover, the fixing of the tension-binding belts 4 and 5 and the tensioning implement 7 may be accomplished by adhesive bonding, fusion bonding, or riveting.

The "VELCRO®" used for the tensioning implement 7 may be replaced by fasteners, hooks, snaps, or the like.

Figure 6:
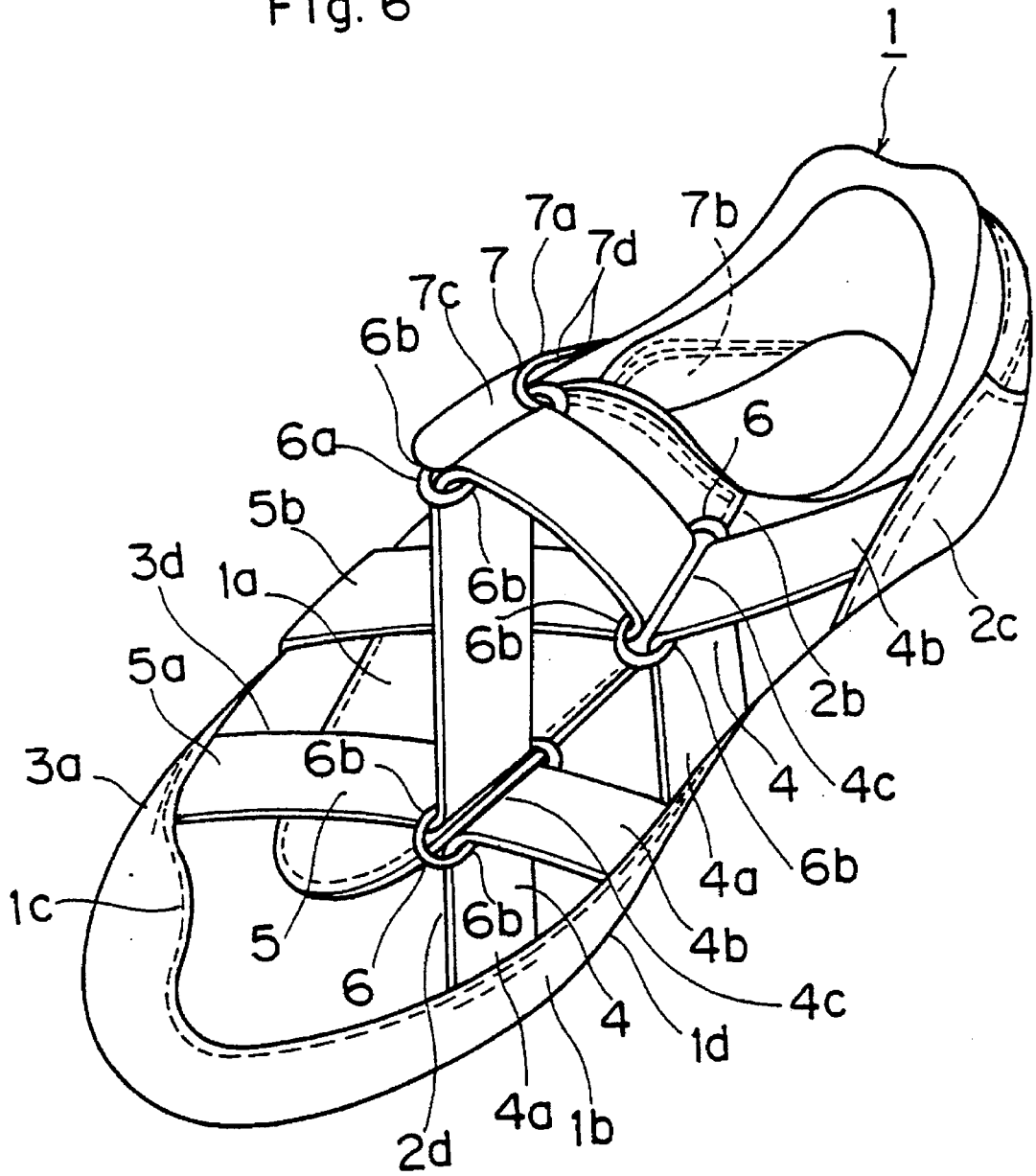
FIG. 6 is an axonometric view of the shoe in relation to a further different embodiment of the present invention.

The shoe 1 may be provided with an additional tension-binding belt 4, being fashioned in an inverted V shape, as shown in FIG. 6. This tension-binding belt 4 is arranged behind the above-mentioned tension-binding belt 4. In this case the tension-binding belt 5 is provided with an additional turnover portion, and the end 5*b* of the tension-binding belt 5 is sewn to the forward lower part 3*a* of the outside vamp 3 of the shoe 1. The tension-binding belt 5 and the additional tension-binding belt 4 are coupled to each other by an additional free ring 6. This arrangement permits finer adjustment. Although not shown in the figure, the shoe 1 may have three or more of the tension-binding belts 4.

Figure 7A:
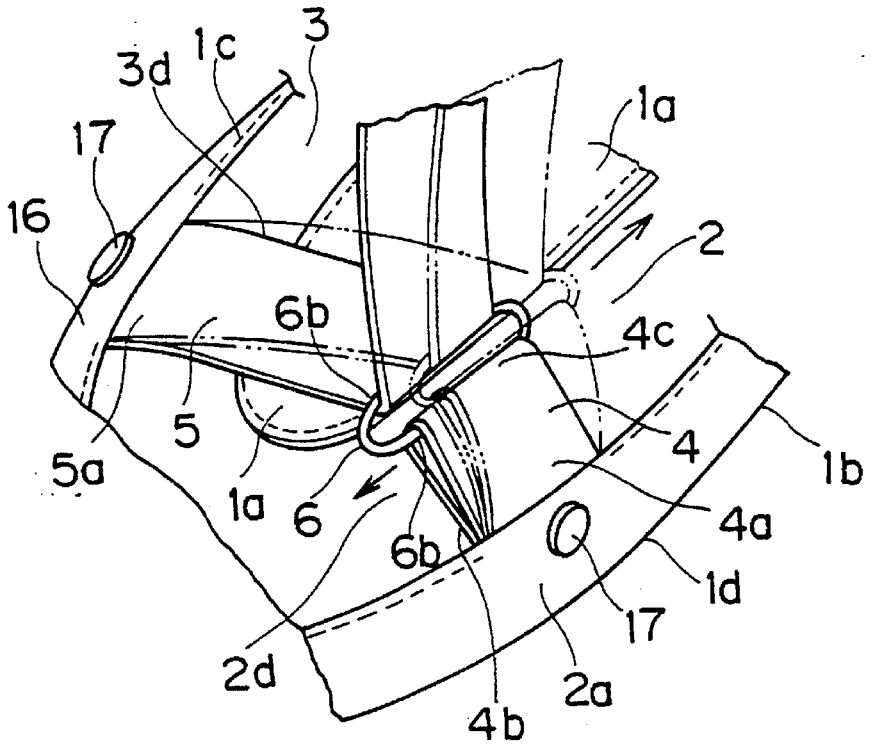
FIGS. 7(A) and 7(B) are partial axonometric views of the shoe in relation to a further different embodiment of the present invention.
Figure 7B:
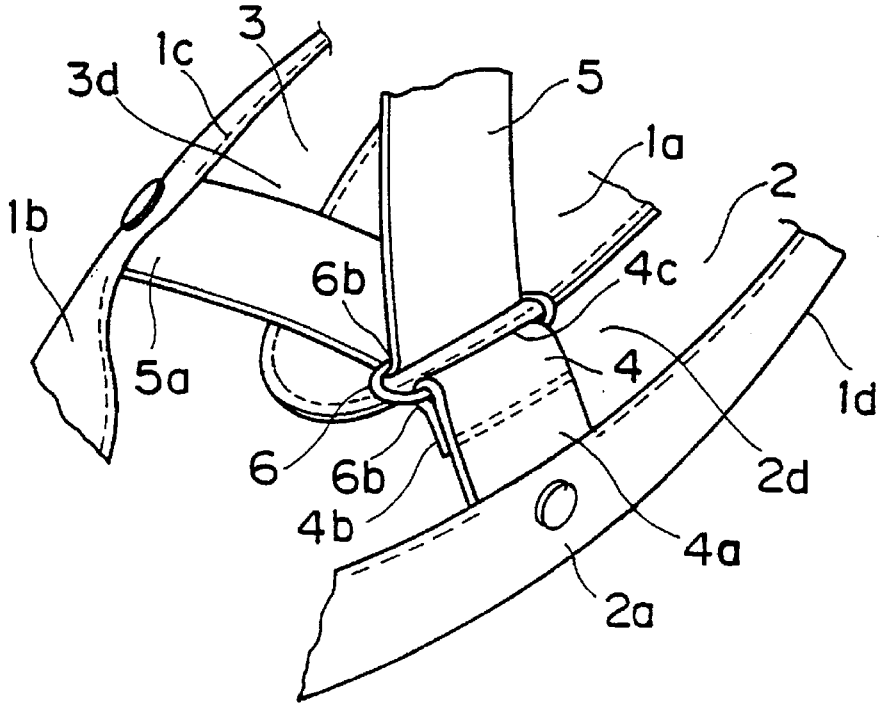
Figure 8:
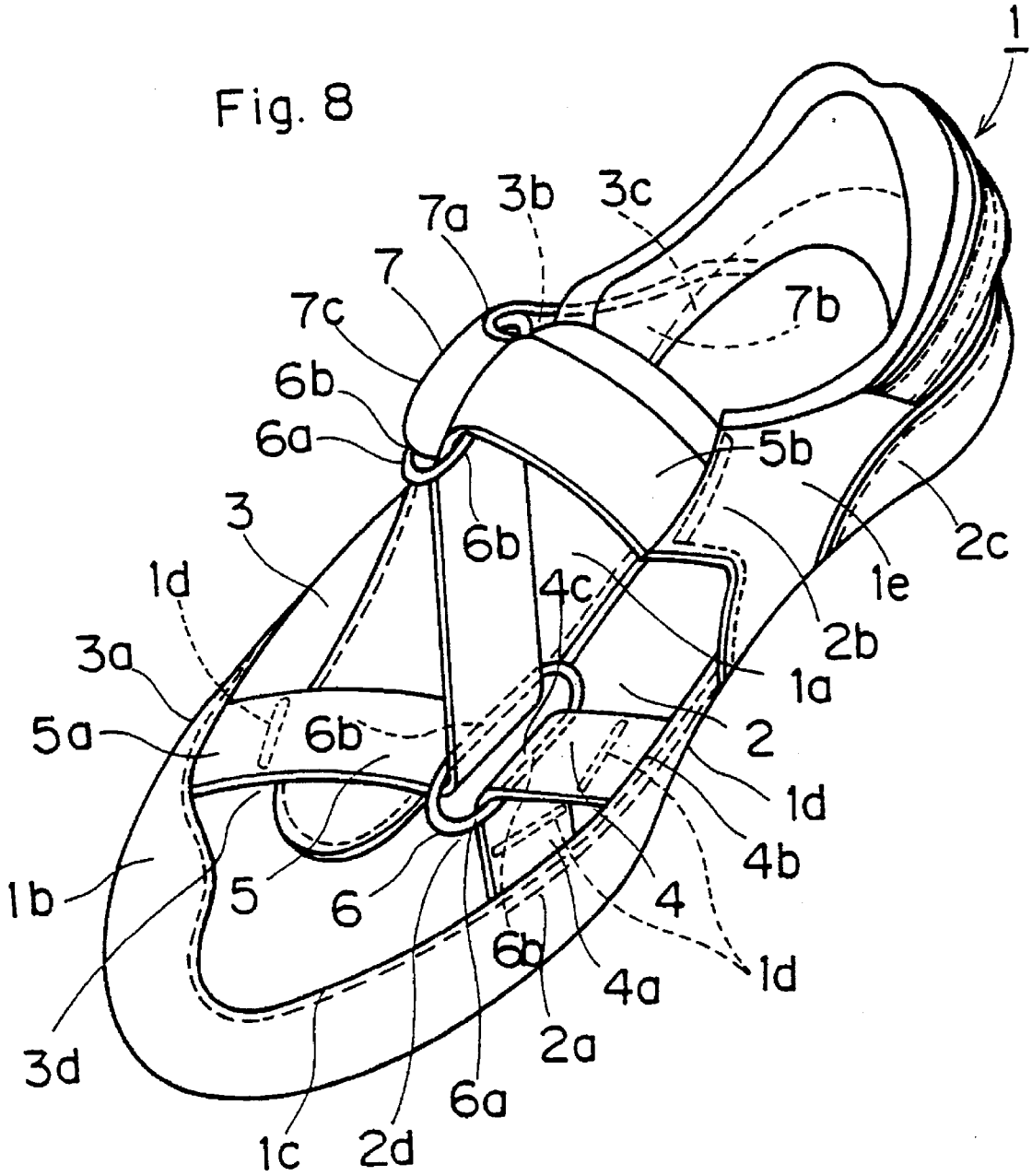
FIG. 8 is an axonometric view of the shoe in relation to a further different embodiment of the present invention.

The tension-binding belt 4 may be folded back such that its two ends 4*a* and 4*b* meet each other, as shown in FIG. 7 (A). In this case it is possible to reduce the number of pins 17 required. The tension-binding belt 4 may be constructed such that its end 4*b* is sewn to the tension-binding belt 4 itself, as shown in FIG. 7(B).

Figure 9:
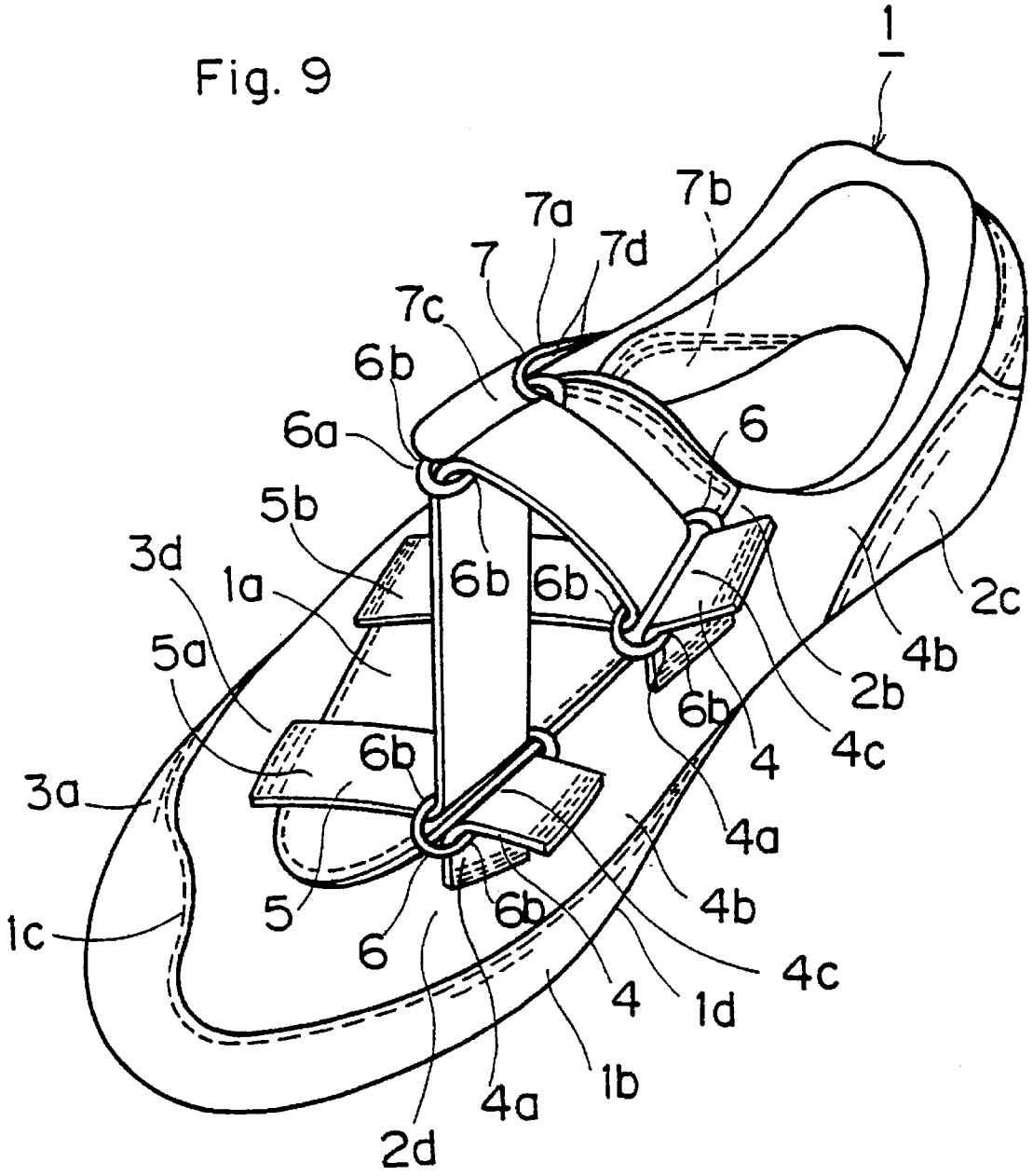
FIG. 9 is an axonometric view of the shoe in relation to a further different embodiment of the present invention.

The tension-binding belt 4 may be sewn to the shoe main body at the forward lower part 2*a* and the forward upper part 2*d*, with the part 1*d* included. The tension-binding belt 5 may be sewn to the shoe main body at the forward lower part 3*a* and the forward upper part 3*d*, with the part 1*d* included. Alternatively, the tension-binding belts 4 and 5 may be sewn to the forward upper parts 2*d* and 3*d* alone, respectively, as shown in FIG. 9.

The free ring 6 (or 6*a*) may be elliptic or rectangular in shape. The linear catching portion 6*b* may have a friction element to prevent the tension-binding belts 4 and 5 and the tensioning implement 7 from sliding easily. The free ring 6 (or 6*a*) may have a portion with a wavy or irregular surface in place of the linear catching portion.

The tension-binding belts 4 and 5 and the tensioning implement 7 may be made of rubber, leather, jute, or the like. They may also be constructed of a plurality of cords combined in a belt form. They may have an elliptic or polygonal section.

The tension-binding belt 4 may be disposed outside the shoe 1, and the tensioning implement 7 disposed inside the shoe 1.

Another embodiment of the present invention will be described with reference to FIGS. 10 and 11.

Figure 10:
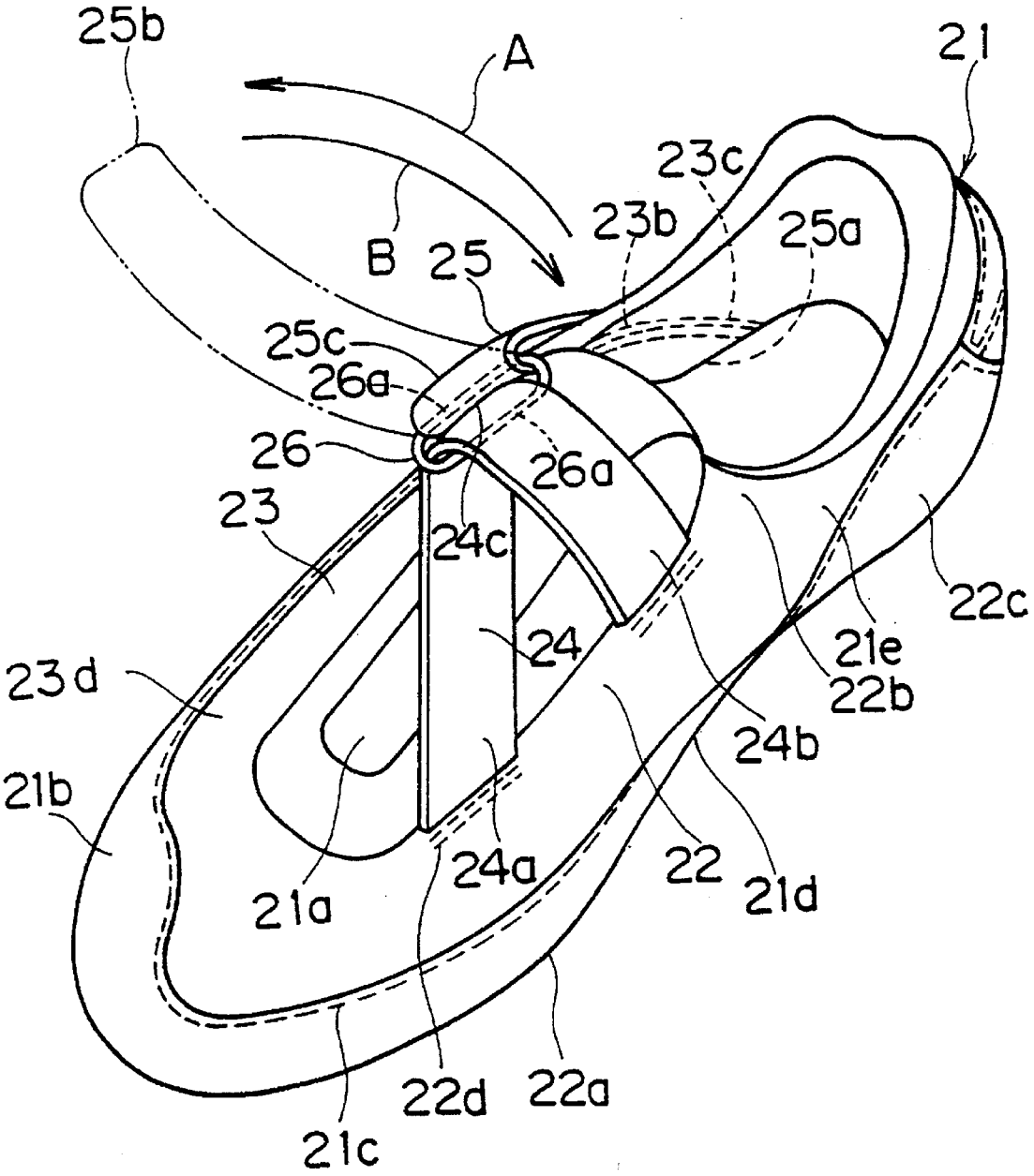
FIG. 10 is an axonometric view of the shoe in relation to a further different embodiment of the present invention.
Figure 11:
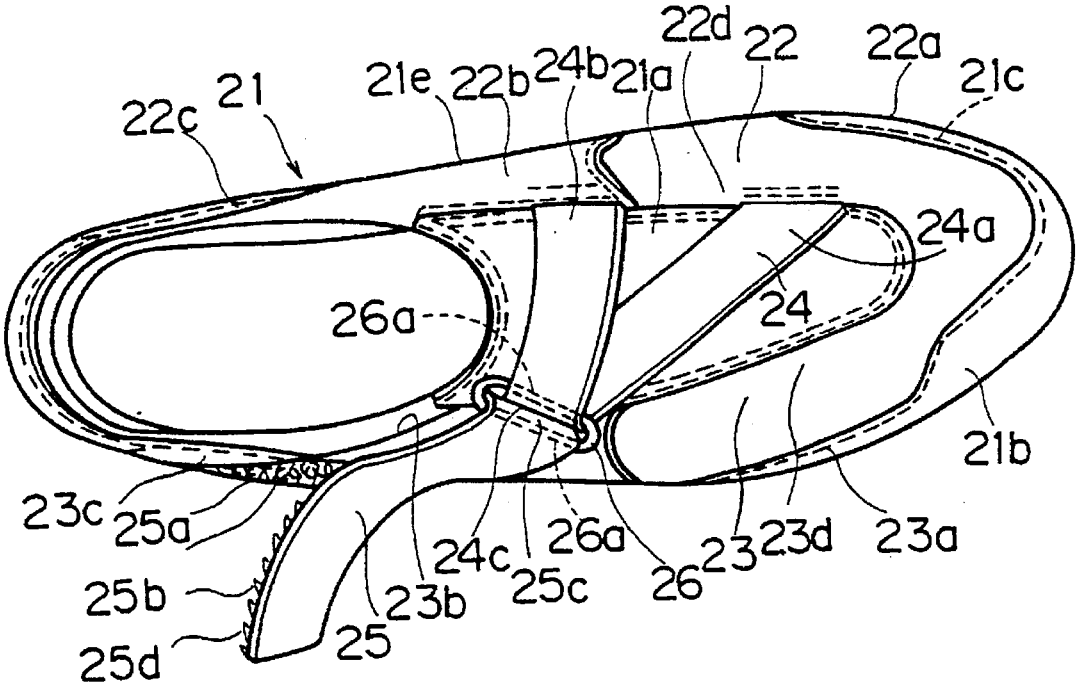
FIGS. 11(A) and 11(B), which shows the same shoe as FIG. 10, is a plan view (A) and a side view (B).
Figure 11:
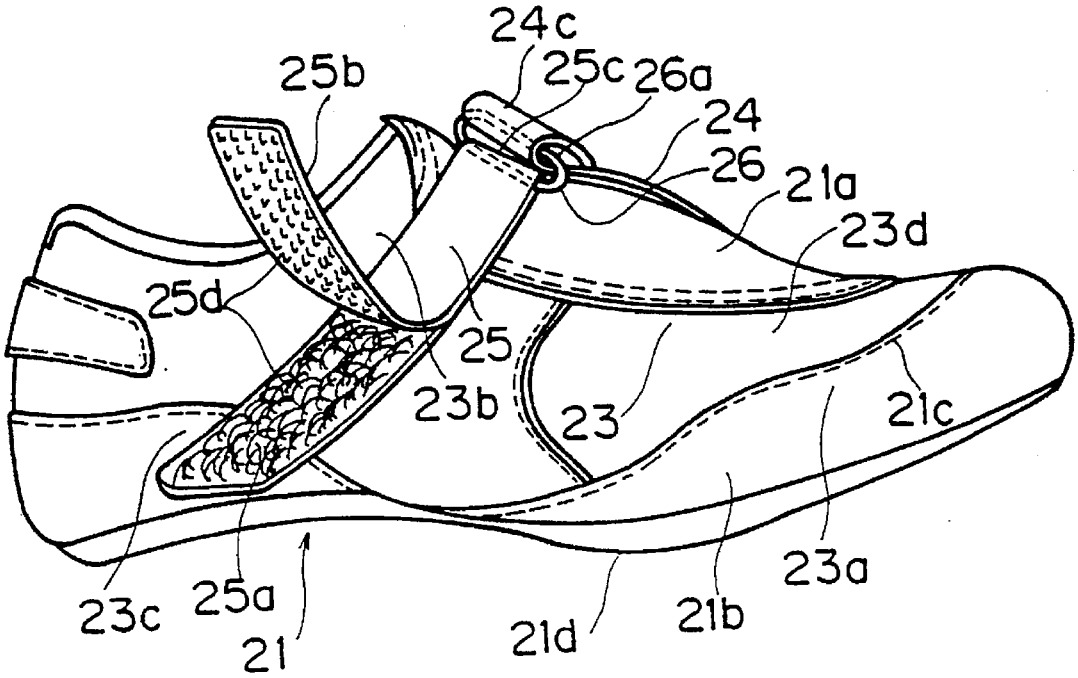

The shoe 21 shown in FIGS. 10 and 11 has a cloth pad 21*a* in the forward half of its opening. The sole of the shoe 21 is provided with a fitting (not shown) which fastens the shoe 21 to the bicycle pedal.

The shoe 21 has a tension-binding belt 24 made of non-stretchable plastic such as nylon, with one end 24*a* thereof sewn to the forward upper part 22*d* of the inside vamp 22 and the other end 24*b* thereof sewn to the rear upper part 22*b* of the inside vamp 22.

On the outside vamp 23 of the shoe 21 is a tensioning free ring 26 through which the tension-binding belt 24 is passed to be freely shiftable. The belt 24 is folded over (in an inverted V pattern) at the free ring 26. The free ring 26 is an elliptic member having a pair of opposing, linear catching portions 26*b*.

The tensioning implement 25 is made of a plastic having no elasticity, such as nylon. One side 25*a* constituting a free end and another side 25*b* constituting a fixed end, and a turnover portion 25*c* between the two pieces 25*a* and 25*b*, are provided. A pair of "VELCRO®" gripping elements 25*d* are sewn to the opposing sides of the sides 25*a* and 25*b*, so that it is possible to adjust the position of the turnover portion 25*c* by placing the one side 25*a* on the other side 25*b*. The side 25*b* is sewn to the outside of the shoe 21 within a diagonal area extending from the rear upper part 23*b* to the rear lower part 23*c*.

Next, the method of using the shoe 21 will be explained.

To put on the shoe 21 shown in FIG. 10, the side 25*a*, which is placed on and engaged with the side 25*b* of the tensioning implement 25, is grasped and then peeled off upward (in the direction of the arrow A) as shown in FIG. 3. In this way the tension-binding belt 24 is loosened momentarily and the shoe 21 is opened.

The shoe 21 in the open state is ready for the easy insertion of a foot (not shown). With the foot inserted, the shoe 21 is tightened as the side 25*a* of the tensioning implement 25 is placed on and engaged with the side 25*b* of the tensioning implement 25 in the direction of the arrow B. The shoe 21 holds any foot firmly and comfortably, due to fine changes in position of the free ring 26 for the tension-binding belt 24, as well as of the tensioning implement 25, according to the height and width of the instep of the feet of the individual wearer. The change in position of the free ring 26 leads to subtle change in position of the tension-binding belt 24 and of the folded-back position of the tensioning implement 25.

In addition, the side 25*a* of the tensioning implement 25 is affected only slightly by the deformation of the shoe 21 because it is sewn to the side of the shoe 21 within a very narrow strip area. Therefore, the taught state of the shoe 21 is maintained, without the belt 24 getting loose, even when the shoe 21 is used by a racing cyclist who subjects the shoe 21 to severe upward and downward movement which entirely deforms the shoe 21. Furthermore, when the shoe 21 is bound tight, the tension-binding belt 24 hardly causes wrinkling, and it is possible to maintain, for comfortable wear, a good-feeling fit not easily subjected to distorting effects.

Figure 12:
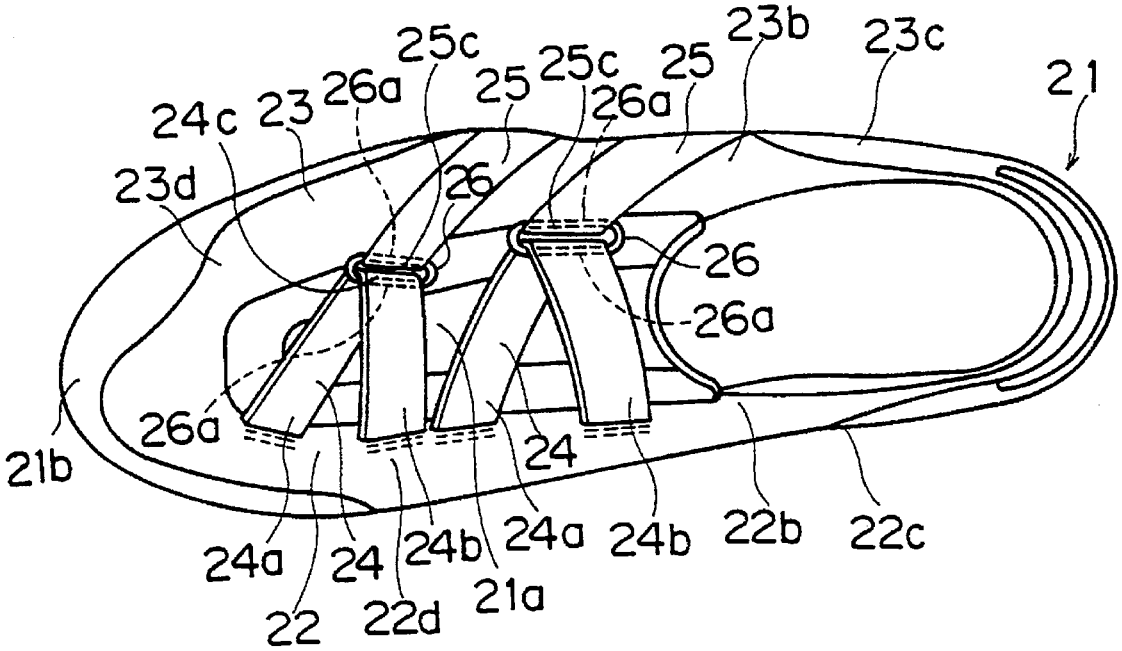
FIGS. 12(A) and 12(B) are plan views of the shoe in relation to a further different embodiment of the present invention.
Figure 12:
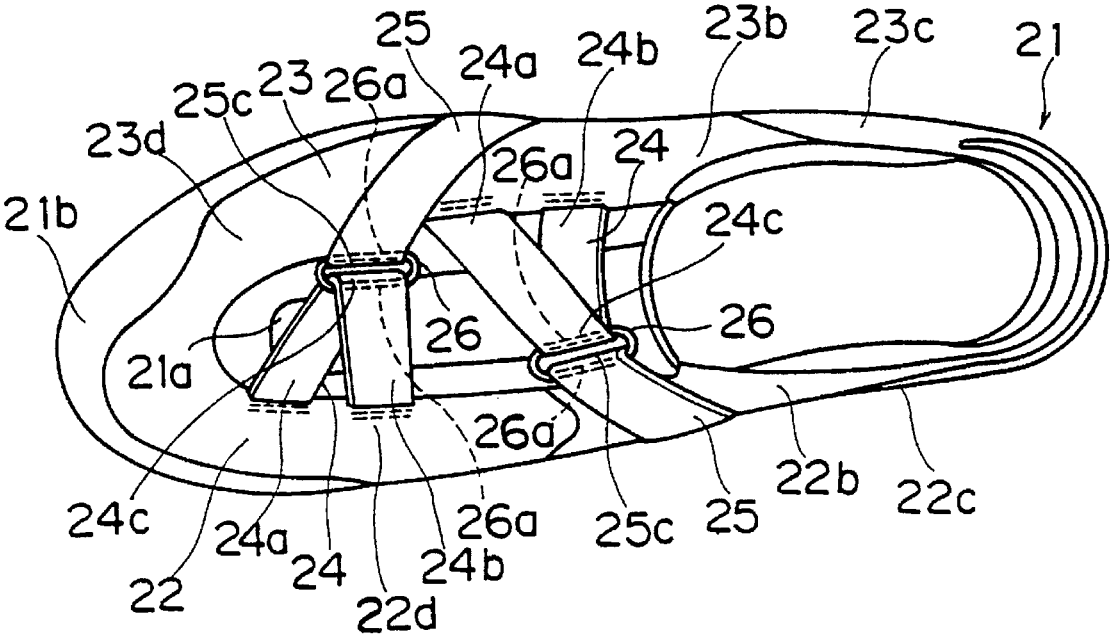

Incidentally, this embodiment may be modified such that the shoe 21 is provided with a pair of tension-binding belts 24 and a pair of tensioning implements 25, as shown in FIG. 12(A). A configuration may be adopted in which one pair of belts 24 and one pair of tensioning implements 25 are provided whose fixed positions are on the right and left conversely, as shown in FIG. 12(B).

Figure 13:
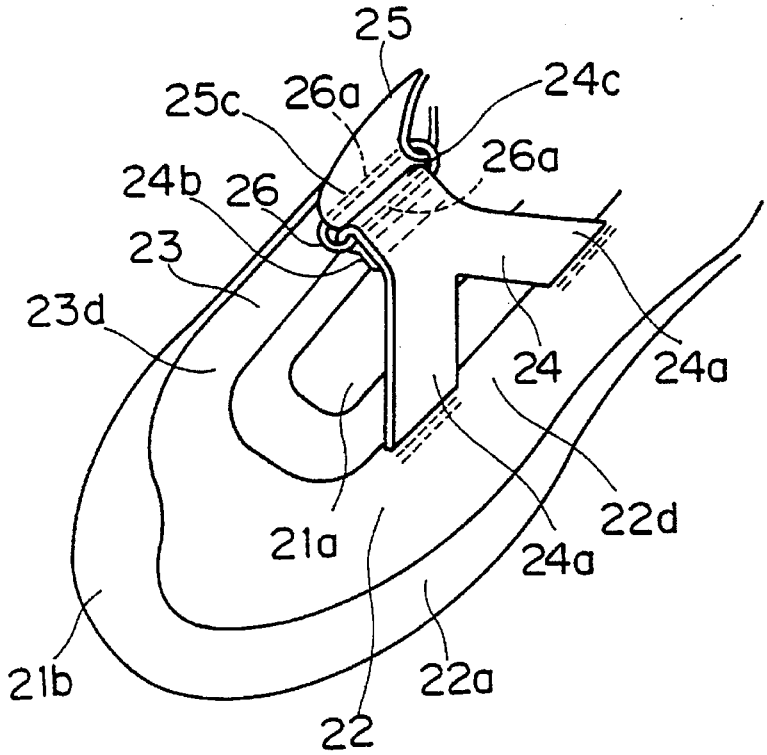
FIGS. 13(A) and 13(B) are axonometric partial views of the shoe in a further different embodiment of the present invention.
Figure 13B:
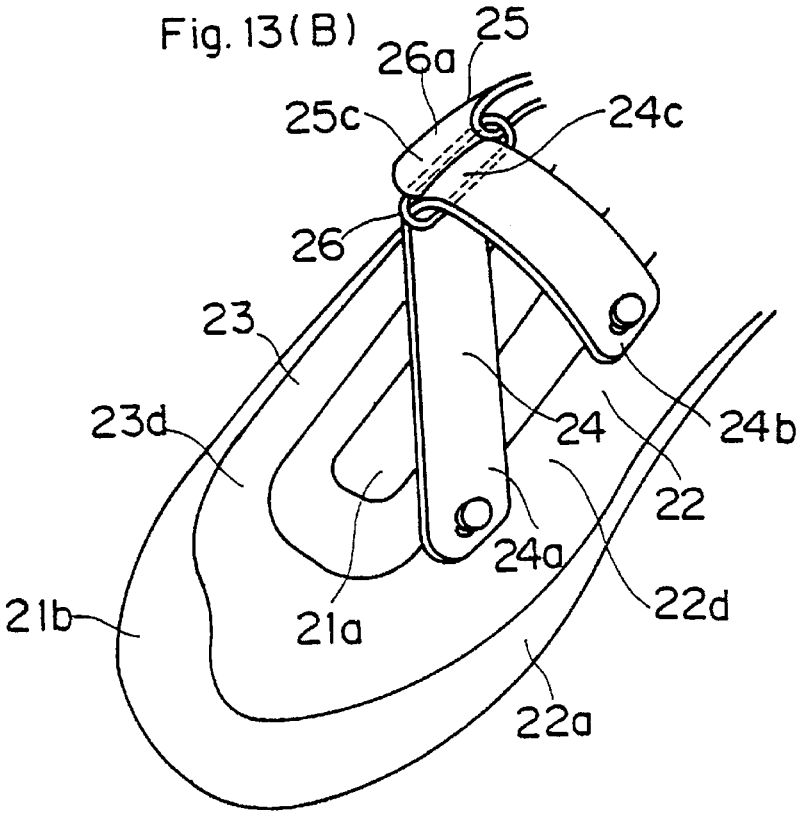
Figure 14:
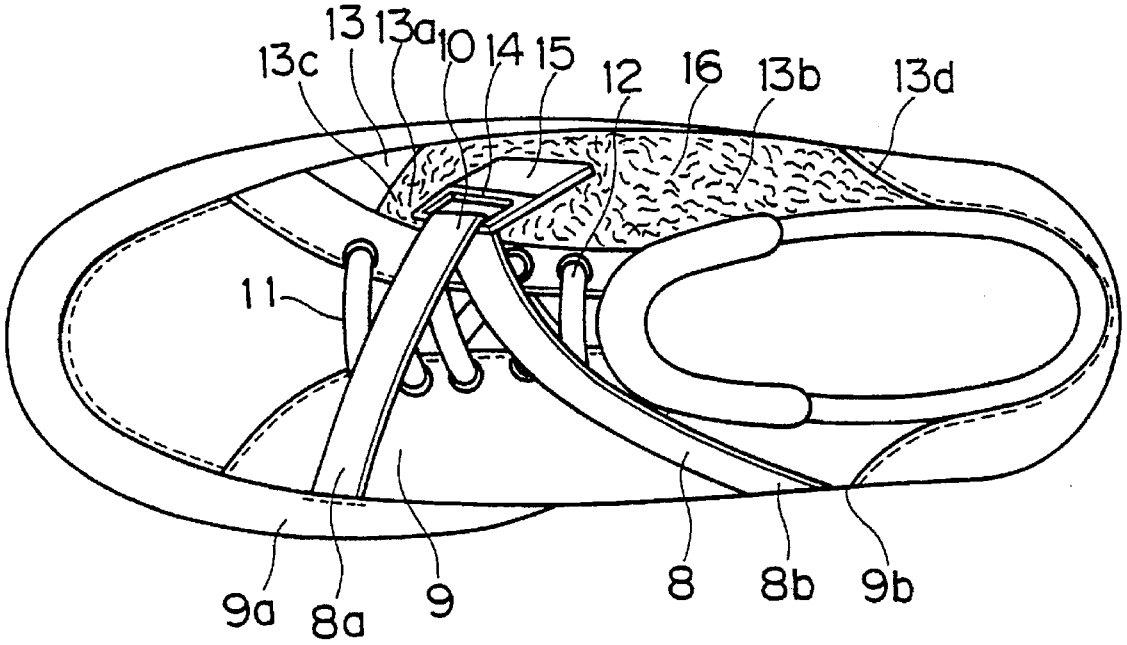
Fig. 14 (PRIOR ART)
FIG. 14 is a plan view of a conventional bicycling shoe.

The tension-binding belt 24 may be fashioned in an inverted Y shape as shown in FIG. 13(A). Herein, the forked ends 24*a* are fixed, and a turnover portion 24*c* is formed by the other end 24*b* that has the tension free ring 26. The tension-binding belt 24 may be pivotally held by means of a press-fitting pin, as shown in FIG. 13(B). In the case of FIG. 13(B), the tension-binding belt 24 permits tightening to any desired degree. Alternatively, the same object may be achieved by pivotally joining it with a stretchable sewing thread. Moreover, the fixing of the tension-binding belt 24 and the tensioning implement 25 may be accomplished by adhesive bonding, fusion bonding, or riveting.

The "Velcro®" used for the tensioning implement 25 may be replaced by fasteners, hooks, snaps, or the like.

The free ring 26 may be elliptic or rectangular in shape. The linear catching portion 26*a* may have a friction element to prevent the tension-binding belt 24 and the tensioning implement 25 from sliding easily. The free ring 26 may be formed with a wavy portion, or have irregular surfaces instead of the linear catching portions.

The tension-binding belt 24 and the tensioning implement 25 may be made of rubber, leather, jute, or the like. They may also be constructed of a plurality of cords combined in a belt form. They may have an elliptic or polygonal section.

The tension-binding belt 24 may be disposed outside the shoe 21, and the tensioning implement 25 disposed inside the shoe 21.

INDUSTRIAL APPLICATION

The present invention provides shoes that are easy to put on and take off and that enable fine adjustments to conform to the shape of the feet of the individual wearer. Furthermore, according to the present invention the realization of outstanding shoes that enable fine adjustment of a maintain condition responding to the form of the individual's foot, and for which even during severe movement a bound-tight condition of the shoes can be firmly maintained, and moreover that are worn comfortably is possible. The shoes obtained according to the present invention are suitable particularly for riders who perform in competition cycling.

As many apparently widely different embodiments of this invention may be made without departing from the spirit and scope thereof, it is to be understood that the invention is not limited to the specific embodiments thereof except as defined in the appended claims.

We claim:

1. A bicycling shoe comprising:

a shoe main body having at a rear upper part a foot insert opening and at a forward upper part a vamp for covering the instep of a foot, said vamp extending to the opening;

a tension-binding belt, both ends of said tension-binding belt fixed to said shoe main body, said tension-binding belt including a first turnover portion, a first portion of said tension-binding belt extending over said vamp in a generally diagonal direction and a second portion of said tension-binding belt extending over said vamp in a generally perpendicular direction and a third portion of said tension-binding belt extending across said vamp generally perpendicular to a length of said show main body proximate said opening;

a tensioning implement, said tensioning implement including a turned-over belt and a flexible, adjustable closure assembly having hook-and-loop type gripping elements disposed on opposing faces thereof, said tensioning implement fixing said tension-binding belt to said shoe main body in a bound and tightened state; and a free ring which links said tension-binding belt and said tensioning implement.

2. A bicycling shoe as in claim 1, wherein a first side of said tensioning implement extends aslant downward from a rear end of said vamp to a lower part of said opening.

3. A bicycling shoe as in claim 1, wherein said shoe main body further has a shoe reinforcing belt on its lower end periphery.

4. A bicycling shoe as in claim 1, wherein said free ring has a pair of opposing, linear catching parts which are broader than widths of said tension-binding belt and said tensioning implement.

5. A bicycling shoe as in claim 1, wherein both ends of said tension-binding belt are each pivotally connected to said shoe main body by a pin.

6. A bicycling shoe comprising:

a shoe main body, said shoe main body having a foot insert opening at a rear upper part and a vamp at a forward upper part;

a first tension-binding belt, both ends of said first tension-binding belt fixed to said shoe main body, said first tension-binding belt including a first turnover portion and a third turnover portion, and at least one portion of said first tension-binding belt extending over said vamp in a generally diagonal direction and another portion of said first tension-binding belt extending over said vamp in a generally perpendicular direction;

a second tension-binding belt, both ends of said second tension-binding belt fixed to said shoe main body, said second tension-binding belt including a second turnover portion disposed adjacent to said first turnover portion;

a first free ring, said first free ring linking said first tension-binding belt and said second tension-binding belt;

a tensioning implement, one end of said tensioning implement attached to said shoe main body, said tensioning implement including a turned-over belt and a flexible, adjustable closure assembly having hook-and-loop type gripping elements disposed on opposing faces thereof, said tensioning implement fixing said first tension-binding belt to said shoe main body in a bound and tightened state; and a second free ring, said second free ring linking said first tension-binding belt and said tensioning implement.

7. A bicycling shoe as in claim 6, wherein one end of said first tension-binding belt and at least one end of said second tension-binding belt is pivotally connected to said shoe main body by a pin.

8. A bicycling shoe as in claim 6, wherein said tensioning implement extends aslant downward from a rear end of said vamp to a lower part of said opening.

9. A bicycling shoe as in claim 6, wherein said shoe main body further has a shoe reinforcing belt on its lower end periphery, and one end of said first tension-binding belt is positioned on said shoe reinforcing belt, and both ends of said second tension-binding belt are positioned on said shoe reinforcing belt.

10. A bicycling shoe as in claim 6, wherein both said first free ring and said second free ring have a pair of opposing, linear catching portions which are broader than widths of said first tension-binding belt and said second tension-binding belt.

11. A bicycling shoe comprising:

a shoe main body having at a rear upper part a foot insert opening and at a forward upper part a vamp for covering the instep of a foot;

a first tension-binding belt which has at least one end connected to said shoe main body and extends over said vamp, said first tension-binding belt including a first turnover portion, a third turnover portion, and a fourth turnover portion, said fourth turnover portion disposed in a space between said third turnover portion and said first turnover portion;

a tensioning implement, said tensioning implement including a turned-over belt and a flexible, adjustable closure assembly having hook-and-loop type gripping elements disposed on opposing faces thereof, said tensioning implement fixing said first tension-binding belt to said shoe main body in a bound and tightened state;

a second tension-binding belt which has at least one end connected to said shoe main body, said second tension-binding belt including a second turnover portion adjacent to said first turnover portion;

a first free ring through which said first and second tension-binding belts are inserted such that said first and second turnover portions contact said ring and said first and second tension-binding belts are linked;

a second free ring through which said third turnover portion and said tensioning implement are inserted such that said first tension-binding belt and said tensioning implement are linked;

a third tension-binding belt which has at least one end connected to said shoe main body, said third tension-binding belt disposed adjacent to said second tension-binding belt and including a fifth turnover portion adjacent to said fourth turnover portion; and a third free ring through which said fourth and fifth turnover portions are inserted such that said first and third belts are linked.

12. A bicycling shoe as in claim 11, wherein said ends of said first tension-binding belt, said second tension-binding belt and said third tension-binding belt are each pivotally connected to said shoe main body by a pin.

13. A bicycling shoe as in claim 11, wherein said tensioning implement extends aslant downward from said rear end of said vamp to said lower part of said opening.

14. A bicycling shoe as in claim 11, wherein said shoe main body further has a shoe reinforcing belt on its lower end periphery, and both ends of said first tension-binding belt and said second tension-binding belt, and one end of said third tension-binding belt, are positioned on said shoe reinforcing belt.

15. A bicycling shoe as in claim 11, wherein each of said first free ring, said second free ring, and said third free ring includes a pair of opposing, linear catching portions which are broader than the widths of each of said first tension-binding belt, said second tension-binding belt, and said third tension-binding belt.

* * * * *